US007307548B2

(12) United States Patent
Park et al.

(10) Patent No.: US 7,307,548 B2
(45) Date of Patent: Dec. 11, 2007

(54) GEOGRAPHICAL INFORMATION SUPPLY SYSTEM AND METHOD USING RFID, AND TRAFFIC INFORMATION SUPPLY SYSTEM USING RFID

(75) Inventors: Kyung-bo Park, Suwon-si (KR); Woo-shik Kang, Suwon-si (KR); Si-gyoung Koo, Seoul (KR); Ji-hun Koo, Yongin-si (KR); Pierre Dehaut, Yongin-si (KR)

(73) Assignee: Samsung Electro-Mechanics Co., Ltd., Suwon-si (KR)

( * ) Notice: Subject to any disclaimer, the term of this patent is extended or adjusted under 35 U.S.C. 154(b) by 245 days.

(21) Appl. No.: 11/185,814

(22) Filed: Jul. 21, 2005

(65) Prior Publication Data

US 2006/0017587 A1 Jan. 26, 2006

(30) Foreign Application Priority Data

Jul. 22, 2004 (KR) ..... 10-2004-0057329

(51) Int. Cl.
*G08G 1/00* (2006.01)

(52) U.S. Cl. ..... 340/928; 340/933; 340/941; 340/902; 340/903; 340/988; 340/539.17; 340/995.13

(58) Field of Classification Search ..... 340/928, 340/933, 941, 902, 903, 988, 435, 539.17, 340/995.13

See application file for complete search history.

(56) References Cited

U.S. PATENT DOCUMENTS 5,245,346 A * 9/1993 Nishimura et al. ..... 342/42
6,791,472 B1 * 9/2004 Hoffberg ..... 340/905

FOREIGN PATENT DOCUMENTS

KR 2000-0000409 A 1/2000

* cited by examiner

*Primary Examiner*—Tai Nguyen
(74) *Attorney, Agent, or Firm*—Sughrue Mion Pllc.

(57) ABSTRACT

A system and method for providing geographical information to a driver of a vehicle using radio frequency identification (RFID). Also provided is a traffic information supply system using RFID. The geographical information supply system includes a reader provided near a road which outputs a first signal and receives a second signal generated in response to the first signal; a tag that senses the first signal, converts information on a destination into the second signal in response to the first signal, and outputs the second signal. Also included is a first control unit which extracts and outputs the destination information from the second signal, receives geographical information to the destination, and supplies the geographical information to a driver. A server generates the geographical information corresponding to the destination information and outputs the generated geographical information to the first control unit.

15 Claims, 3 Drawing Sheets

GEOGRAPHICAL INFORMATION SUPPLY SYSTEM AND METHOD USING RFID, AND TRAFFIC INFORMATION SUPPLY SYSTEM USING RFID

CROSS REFERENCE TO RELATED APPLICATIONS

This application claims the priority from Korean Patent Application No. 10-2004-0057329, filed on Jul. 22, 2004, in the Korean Intellectual Property Office, the disclosure of which is incorporated herein in its entirety by reference.

BACKGROUND OF THE INVENTION

1. Field of the Invention

Systems and methods consistent with the present application relate to supplying geographical and traffic information using radio frequency identification (RFID), and more particularly, to supplying geographical information and traffic information to a driver using an RFID tag mounted on a vehicle.

2. Description of the Related Art

In conventional methods of supplying geographical information, there are methods of supplying geographical information to drivers using a global positioning system (GPS) or mobile phones.

However, the various methods of supplying geographical information using GPS have problems. For example, these systems are subject to communication obstacles when passing through a tunnel or because of the influence of adverse weather. A further disadvantage is, when changing data related to the geographical information, the new data should must be downloaded.

The method of supplying the geographical information by using a mobile phone also has problems associated with communication obstacles. Additionally, whenever using a geographical information supply service, a user connects to a server for supplying the geographical information, and the number of simultaneous users of the service may be limited.

SUMMARY OF THE INVENTION

According to an aspect of the, present invention, there is provided a geographical information supply system and method for outputting geographical information, including a remaining distance and a direction to a destination, to a driver using radio frequency identification (RFID).

The present invention also provides a traffic information supply system for obtaining and outputting traffic volume information using RFID.

According to an aspect of the present invention, there is provided a geographical information supply system which contains: a reader installed on a road which outputs a first signal and receives a second signal generated in response to the first signal; a tag that senses the first signal, converts information on a destination into the second signal in response to the first signal, and outputs the second signal; a first control unit which extracts and outputs the destination information from the second signal, receives geographical information on the destination, and supplies the geographical information to a driver; and a server which generates the geographical information corresponding to the destination information and outputs the geographical information to the first control unit.

According to another aspect of the present invention, there is provided a geographical information supply method in which: a first signal is output at predetermined intervals using a reader installed near a road; receiving a second signal which includes information on a destination in response to the first signal; extracting the destination information from the second signal and generating geographical information on the destination; and supplying the geographical information to a driver.

According to another aspect of the present invention, there is provided a traffic information supply system which contains: a reader installed near a road, which outputs a first signal and receives a second signal generated in response to the first signal; a tag that senses the first signal and outputs the second signal in response to the first signal; a server which generates traffic information, including traffic volume of the road, from the second signal and outputs the generated traffic information; and a first control unit that transmits the second signal received from the reader to the server and supplying the traffic information output from the server to a driver.

BRIEF DESCRIPTION OF THE DRAWINGS

The above and other aspects of the present invention will become more apparent by describing certain exemplary embodiments thereof with reference to the attached drawings in which.

DETAILED DESCRIPTION OF EXEMPLARY EMBODIMENTS OF THE INVENTION

The present invention will now be described in more detail with reference to the accompanying drawings.

Figure 1:
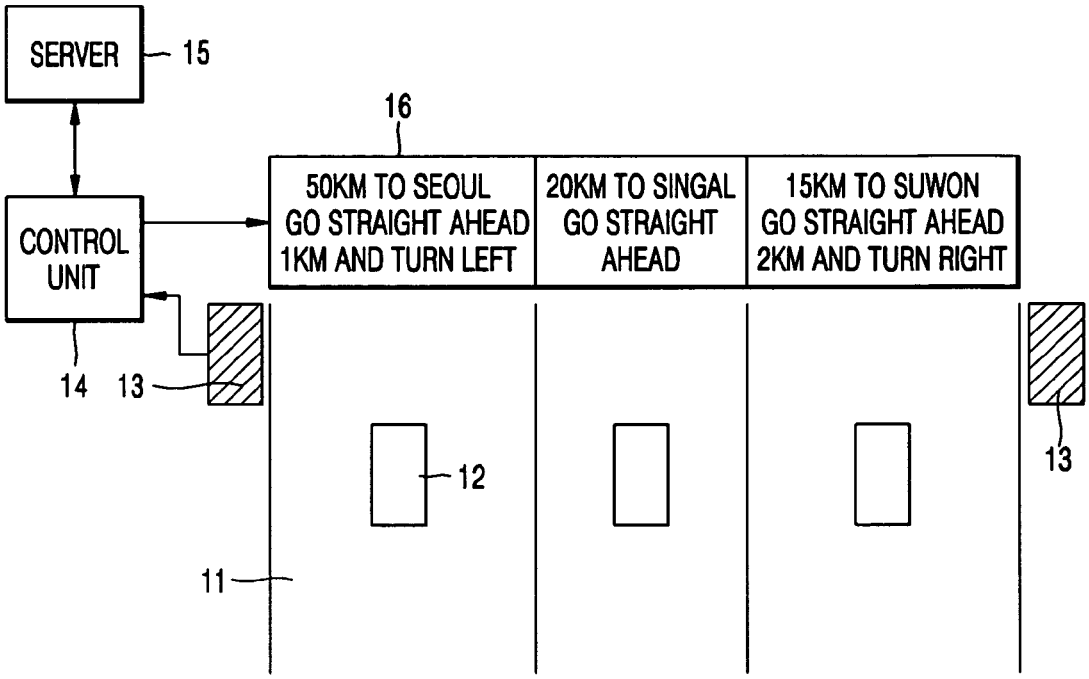
FIG. 1 illustrates schematically a geographical information supply system using RFID according to an exemplary embodiment of the present invention.

FIG. 1 illustrates schematically a geographical information supply system using RFID according to an exemplary embodiment of the present invention.

When a vehicle 12, including a RFID tag (not shown), runs on a road 11, an RFID reader 13 installed on the road 11 receives an RF signal output from the RFID tag. The tag may be either mounted on the vehicle 12 or provided to a driver, and outputs the received RF signal to a control unit 14. The RFID tag includes destination information which may be input by a driver. The RFID reader 13 may be installed at any location proximate to the road, such that the reader 13 can make RF contact with the RFID tag. For example, the reader 13 may be on a right or left side of the road 11, or may be placed below or above the surface of the road 11. The reader 13 should be placed within a propagation range of the RF signal. The RFID reader 13 outputs the RF signal at predetermined intervals.

The control unit 14 connects with a server 15 to provide the destination information read from the RFID tag to the server 15. The control unit 14 supplies information, such as a remaining distance or a direction, etc., from a current position of the vehicle 12 to a destination, to a driver through a road sign 16, a display device, or a voice replaying device mounted on the vehicle 12.

Figure 2:
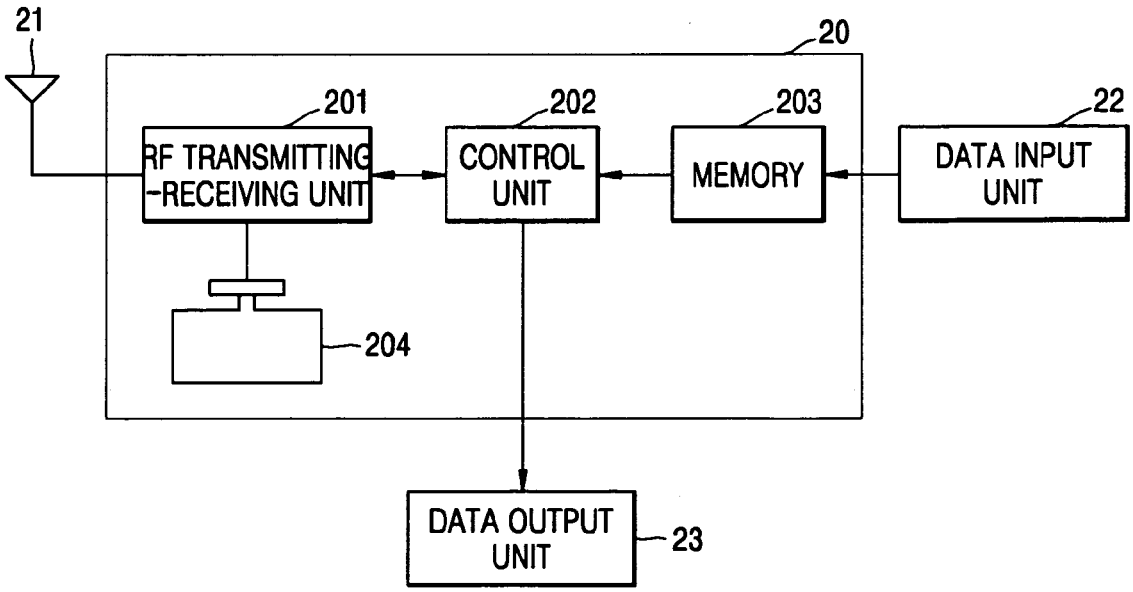
FIG. 2 is a block diagram illustrating an RFID tag and peripheral units mounted on a vehicle.

FIG. 2 is a block diagram illustrating an RFID tag and peripheral units mounted on a vehicle 12, or otherwise provided to the driver.

An RFID tag 20 contains an RF transmitting-receiving unit 201, a control unit 202, a memory 203, and an RF sensor 204. Reference numeral 21 designates an antenna for transmitting-receiving the RF signal. Reference numeral 22 designates a data input unit through which the destination information is input to the memory 203 by a driver. Reference numeral 23 designates a data output unit such as a display device and/or a voice replaying device.

Figure 3:
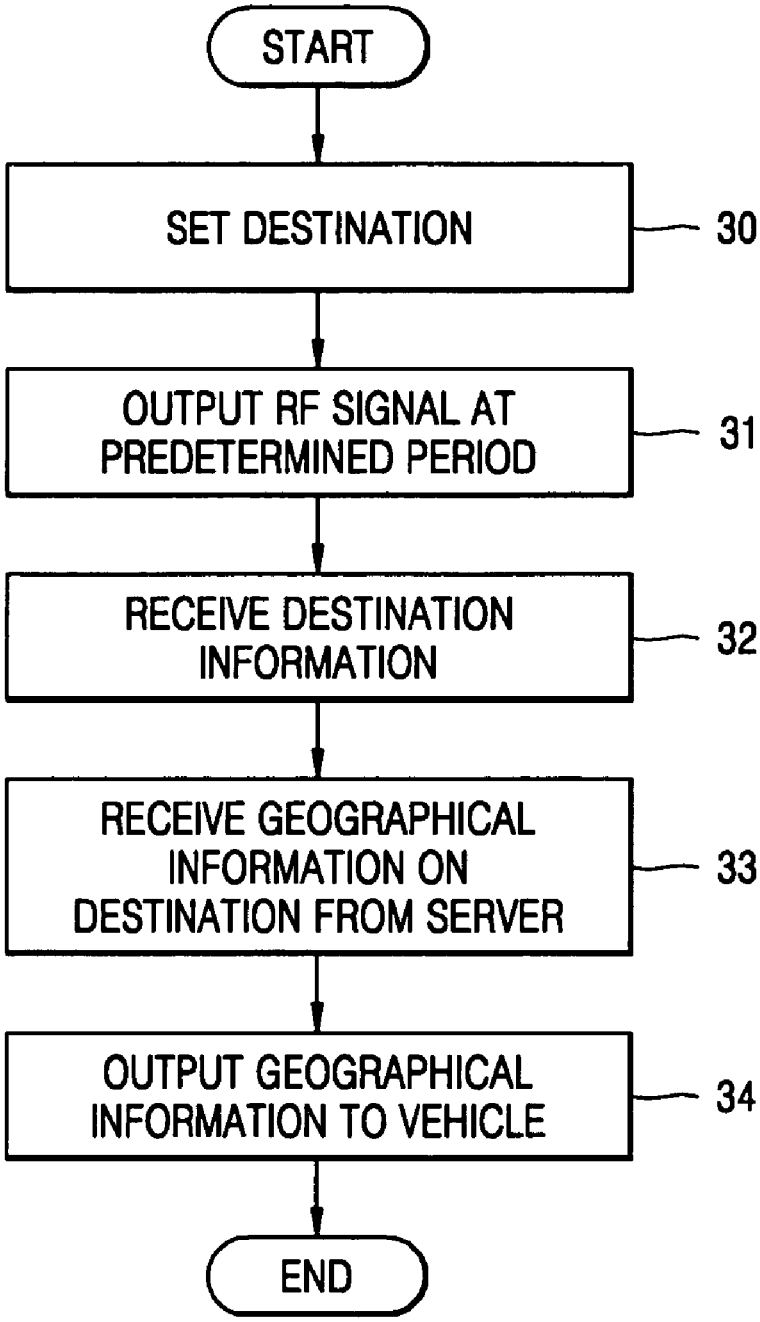
FIG. 3 is a flowchart illustrating a geographical information supply method using RFID according to an exemplary embodiment of the present invention.

Operations of the geographical information supply system shown in FIG. 1 and RFID unit shown in FIG. 2 will be described with reference to the flowchart of FIG. 3.

Initially, the driver inputs destination information to the memory 203, which stores the information, through the data input unit 22 before start (operation 30). The RFID reader 13 outputs an RF signal at predetermined intervals, and the RF sensor 204 senses the RF signal output from the RFID reader 13 when the vehicle 12 is running on a road (operation 31). When the RF signal is sensed, the control unit 202 transmits the destination information and an ID stored in the memory 203 to the RF transmitting-receiving unit 201, and the RF transmitting-receiving unit 201 converts the destination information and identification (ID) into an RF signal and outputs the converted RF signal through the antenna 21. In an exemplary embodiment, the RF signal sent by the tag to the RFID reader 13 has the same frequency as the signal output by the RFID reader 13 to the tag.

The RFID reader 13 transfers the destination information output from the vehicle 12 to the control unit 14 (operation 32). The control unit 14 connects with the server 15, and the server 15 outputs information, such as a remaining distance and a direction, etc. from a current position of the vehicle 12 to the destination, to the control unit 14 (operation 33). The control unit 14 and the RFID reader 13 may be connected wirely or wirelessly, and the server 15 and the control unit 14 may be also connected wirely or wirelessly.

The server 15 stores the geographical information. The geographical information includes information on, for example, road information, approaches, exits or junctions of a road, etc. The server 15 can also store various positional information, for example, locations of gas stations, resting places, or restaurants, etc. and can output the stored position information with the geographical information.

When receiving the information such as a remaining distance and a direction, etc. from the server 15, the control unit 14 allows the road sign 16 to display the received information to provide the information to the driver (operation 34). The road sign 16 may be prepared with a type of electronic display board for displaying the information.

In another exemplary embodiment, the control unit 14 converts the received information and the RFID of the vehicle 12 into an RF signal and transmit the converted RF signal to the RFID tag. In this case, the RF transmitting-receiving unit 201 transmits information received through the antenna 21 to the control unit 202, and the control unit 202 supplies the received information to a driver through the data output unit 23. The data output unit 23 may be a display device or a voice replaying device.

In an exemplary embodiment, the RF signal from the control unit 14 has the same frequency as the RF signal from the tag to the reader 13 or the original RF signal from the reader 13 to the tag.

Additionally, the traffic information can be collected by using the geographical information supply system shown in FIG. 1 and the RFID tag shown in FIG. 2.

Figure 4:
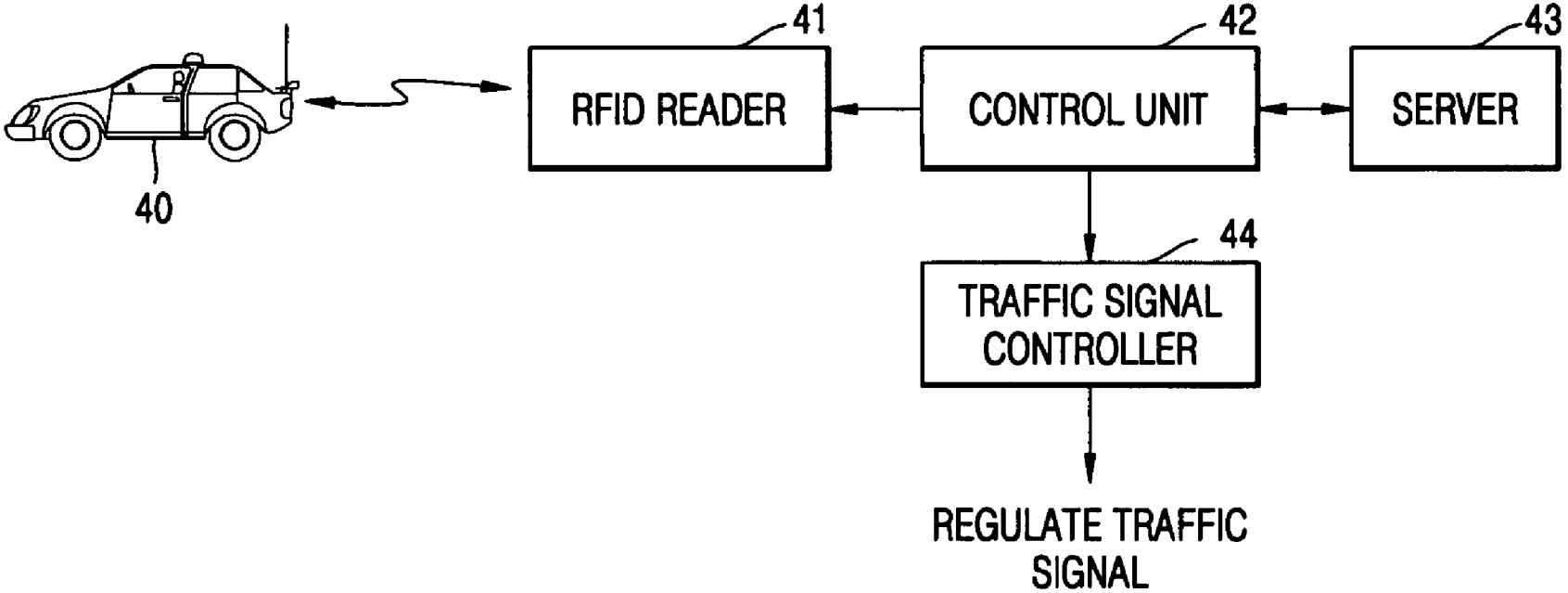
FIG. 4 is a block diagram illustrating a traffic information collecting system.

FIG. 4 is a block diagram illustrating a traffic information collecting system, according to an exemplary embodiment of the present invention.

The traffic information collecting system comprises an RFID reader 41, a control unit 42, a server 43, and a traffic signal controller 44.

The RFID reader 41 periodically transmits an RF signal and receives an RF signal output from the RFID tag, an example of which is shown in FIG. 2, mounted on a vehicle 40. The control unit 42 outputs destination information included in the RF signal received from the vehicle 40 to the server 43. The server 43 obtains a traffic amount, a congestion situation, etc. at a current position using the destination information, and can obtain statistical information on the destination of the vehicle 40. As described above, the control unit 42 can supply the traffic amount or the congestion situation of the current position, received from the server 43, to the vehicle 40, can output a suitable control signal to the traffic signal controller 44, to regulate a traffic signal, so that the traffic can be regulated.

As described above, according to the present invention, it is possible to receive the information recorded on RFID from the vehicle having an RFID tag on which the destination information is recorded, and to supply geographical information and travel information on the destination to a driver. Further, it is possible to obtain traffic information such as a vehicle or a traffic situation, etc. and to perform a traffic control function.

While the present invention has been particularly shown and described with reference to exemplary embodiments thereof, it will be understood by those of ordinary skill in the art that various changes in form and details may be made therein without departing from the spirit and scope of the present invention as defined by the following claims.

What is claimed is:

1. A geographical information supply system comprising:

a reader which is positioned proximate to a road outputs a first signal and receives a second signal, wherein the second signal is generated in response to the first signal;

a tag which senses the first signal, converts destination information on a destination from said first signal into the second signal, and outputs the second signal;

a first control unit which extracts and outputs the destination information from the second signal, receives geographical information on the destination, and supplies the geographical information to a driver; and a server which generates the geographical information corresponding to the destination information and outputs the geographical information to the first control unit.

2. The geographical information supply system according to claim 1, wherein the tag comprises:

a sensor which senses the first signal;

a memory which stores the destination information and identification information;

a second control unit which reads the destination information and the identification information from the memory in response to the first signal, and converts the destination information and the identification information into the second signal; and a signal transmitting unit which outputs the second signal to the reader.

3. The geographical information supply system according to claim 2, wherein the second control signal has a same frequency as the first control signal.

4. The geographical information supply system according to claim 2, wherein the tag further comprises a data input unit through which the destination information is input by the driver.

5. The geographical information supply system according to claim 2, wherein the first control unit transmits the geographical information to the tag in another signal.

6. The geographical information supply system according to claim 5, wherein the another signal has the same frequency as the second signal.

7. The geographical information supply system according to claim 5, wherein the tag further comprises a signal receiving unit which receives the geographical information from the another signal; and wherein the second control unit converts the received geographical information into a driver data and supplies the driver data to the driver.

8. The geographical information supply system according to claim 7, further comprising at least one of a display device which displays the driver data to the driver and a voice replaying device which supplies the driver data to the driver in a audio format.

9. The geographical information supply system according to claim 1, wherein the first control unit controls the display of the geographical information on a road sign.

10. A geographical information supply method comprising:

outputting a first signal at predetermined intervals using a reader installed proximate to a road;

receiving said first signal and outputting a second signal generated in response to the first signal, wherein said second signal includes information on a destination;

receiving the second signal, extracting the destination information, from the second signal, and generating geographical information on the destination based on the destination information; and supplying the geographical information to a driver.

11. The geographical information supply method according to claim 10, wherein the receiving the first signal and generating the second signal is performed by a tag provided in a vehicle or with the driver.

12. The geographical information supply method according to claim 11, wherein the driver inputs the destination information to the tag.

13. The geographical information supply method according to claim 10, wherein the supplying the geographical information to the driver comprises:

converting the geographical information into another signal and outputting the other signal to the tag;

receiving the geographical information and converting the geographical information into data; and at least one of displaying the data to the driver and playing the data in an audio format to the driver.

14. The geographical information supply method according to claim 13, wherein the other signal has a same frequency as either one of the first signal or the second signal.

15. The geographical information supply method according to claim 10, wherein the geographical information is displayed on a road sign.

* * * * *